United States Patent [19]

Malone

[11] Patent Number: 4,843,235

[45] Date of Patent: Jun. 27, 1989

[54] DEVICES FOR PROTECTION OF SENSORS FROM DAMAGING AND INTERROGATING RADIATION

[75] Inventor: Warren L. Malone, Falls Church, Va.

[73] Assignee: United States of America as represented by the Secretary of the Navy, Washington, D.C.

[21] Appl. No.: 334,787

[22] Filed: Feb. 23, 1973

[51] Int. Cl.[4] ..... G01J 5/08

[52] U.S. Cl. ..... 250/237 R; 350/171; 350/172; 350/173; 350/276 R; 350/276 SL; 350/277; 250/526

[58] Field of Search ..... 356/256, 4, 5, 28; 250/526, 199, 287 R; 350/276 R, 276 SL, 277, 278, 171, 172, 173

[56] References Cited

U.S. PATENT DOCUMENTS

| | | | |
|---|---|---|---|
| 2,819,459 | 1/1958 | Dodd | 350/276 SL |
| 3,527,523 | 9/1970 | Travis | 350/171 |
| 3,676,003 | 7/1972 | Naiman et al. | 356/5 |
| 3,734,623 | 5/1973 | Wolber | 356/5 |

*Primary Examiner*—Stephen C. Buczinski
*Attorney, Agent, or Firm*—Thomas E. McDonnell; George Jameson

[57] ABSTRACT

The invention presents means for protecting a remote sensing device such as a missile seeker unit from damaging radiation outside of the sensing band of the detector and interrogating radiation attempting to determine the operating band of the sensor, its modulation rate, timing signal, or similar data which might be used to deteriorate the performance of the sensor.

3 Claims, 1 Drawing Sheet

DEVICES FOR PROTECTION OF SENSORS FROM DAMAGING AND INTERROGATING RADIATION

BACKGROUND OF THE INVENTION

The present invention relates generally to protection of remote sensing devices from interrogating radiation source and more specifically to optical devices which provide false reply signals to the interrogating source. Remote sensing devices such as missile seekers are often interrogated by radiation sources such as laser beams to determine the operating band of the sensor, its modulation rate, timing signal, chop frequency, or similar data which might be used to deteriorate the performance of the sensor. In addition the nature of these sensors is such that they have a high probability of being damaged from high amplitude incoming radiation. Thus a need arose for a device that would shield the remote sensing devices from interrogating radiation which could either damage its sensor or detect parameters of its operation or both.

OBJECT OF THE INVENTION

It is therefore the object of the present invention to provide an inexpensive and reliable device for shielding the sensors of a remote sensing device from interrogating radiation.

Other objects, advantages and novel features of the invention will become apparent from the following detailed description of the invention when considered in conjunction with the accompanying drawings wherein:

SUMMARY OF THE INVENTION

The present invention achieves these results through the use of beam splitting devices and false detection apparatus. In general, a beam splitter is used to divide part of the incoming light away from the detector to protect the detector from high power incoming radiation. The light which is divided away is operated on by a series of optical elements including chop wheels, filters, and false detectors to give false indications to the interrogating source. The beam splitter can also be coated with an optical filter so that only light of the operating frequency of the detector is transmitted to the detector.

BRIFE DESCRIPTION OF THE DRAWINGS

DETAILED DESCRIPTION

Figure 1:
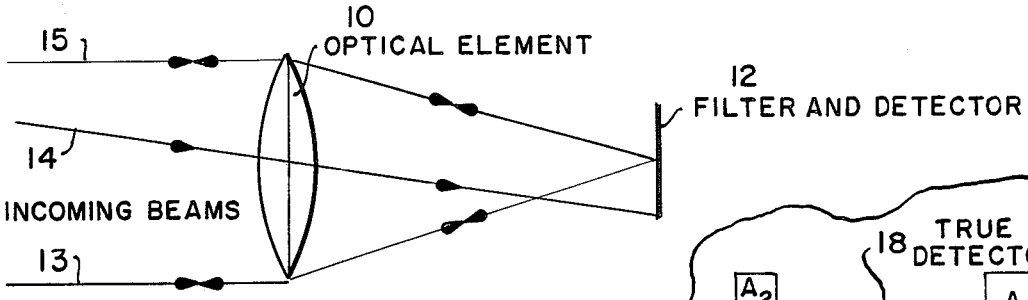
FIG. 1 shows a remote sensing device without optical protection.

FIG. 1 shows a typical remote sensing device having an optical element 10 to focus the incoming radiation and a detector 12 with a filter mounted on its surface. Incoming beams such as beams 13 and 15 will be reflected back along their axis and return to their point of origin. Similarly incoming beans such as bemas 14 which are at an angle to the axis of the optical system as shown in FIG. 1 will reflect a certain portion of radiation back to its origin since the filter and detector are usually not prefectly flat. The system in effect acts like a low grade retro-reflector. A laser or similar source can thus be used to interrogate the receiver by studying the radiation which returns from the sensor. In this manner the collimated source can determine the chop frequency, spectral response, general method of scan and similar parameters which might be used to counter the sensor. In addition, the same source might be used to damage the optical elements, filter and detectors of the sensor. If is thus desirable to provide means for protecting the sensors from both interrogating and damaging radiation.

Figure 2:
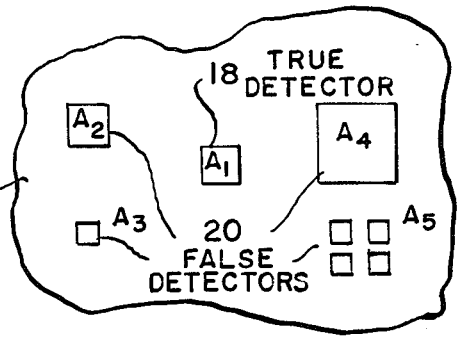
FIG. 2 shows a detecting surface of one embodiment of the invention.

FIG. 2 shows a detecting device for use with the structure of FIG. 1 which provides protection against interrogating radiation through the use of a series of false detectors. It consists of a conventional true detector 18 which is overcoated or covered with an interference filter 16 which provides spectral selectively for the true detector 18. Small partially absorbing semiopaque materials 20 are placed on top of the interference filter to act as false detectors so that either a symmetric or random array of various size flase and real detectors are seen by the interrogating radiation. The false detectors 20 are of approximately the same absorptivity as the real detector but with absorptivity peaks occurring at different wavelengths. The interrogating device will thus interpret the return as a variety of detectors operating at different spectral regions. The detecting device of FIG. 2 however, used in conjunction with the apparatus of FIG. 1, provides no protection against damaging radiation.

Figure 3A:
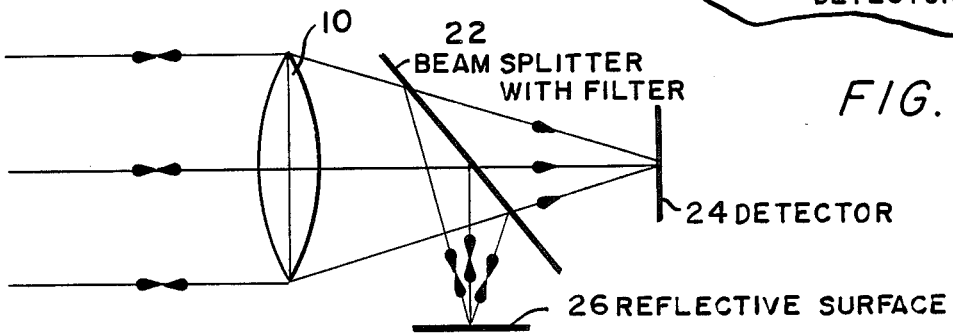
FIG. 3A shows a second embodiment of the invention.

The apparatus of FIG. 3A shows another embodiment of the invention which protects its detector 24 from both interrogating and damaging radiation by addition of a beam splitter to the sensor optical system. Mounted on the beam splitter 22 is a reflective filter such as an interference filter which could be either bandpass or band limiting. The bandpass filter provides the greatest protection but is the most expensive to install and fabricate. In any event, the reflective filter allows radiation of a certain frequency to pass to the detector 24 while the remainder of the incoming radiation is reflected to reflective surface 26. The reflective surface can be made to have a broad band of absorptivity or selected bands of absorptivity. Additionally reflective surface 26 can be divided into a series of subareas similar to the false detectors of FIG. 2 having arbitrary sizes and reflectivities. Since both the detector 24 and the reflective surface 26 are primarily reflective, the preponderence of the radiation will be reflected back outside the receiver. Thus the false detectors of reflective surface 26 will make the receiver appear to the interrogating system as if it were operating in a different spectral region. In those instances where the incoming power is expected to be exceptionally large a totally reflecting surface such as collecting and return mirror 28 as shown in FIG. 3B can be used to offer the maximum degree of protection. In addition, radiation shields or baffles 32 can be used to block any scattered light from the detector 24. This modification also permits radiation to leave the optical system with the least amount of scatter. Of course, any motion imparted to reflective surface 26 will be interpreted by the interrogating system as another type of scanning and will imply different scanning frequencies.

Figure 3C:
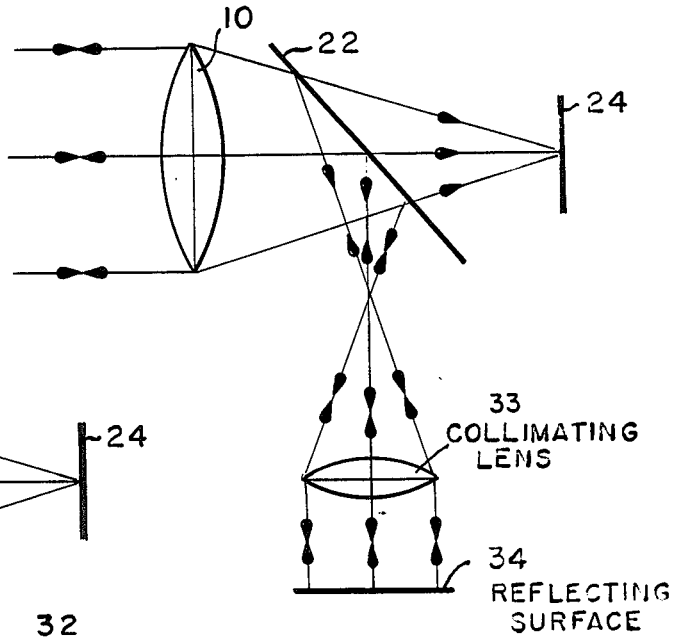
FIGS. 3B and 3C show modifications of the second embodiment of the invention.
Figure 3B:
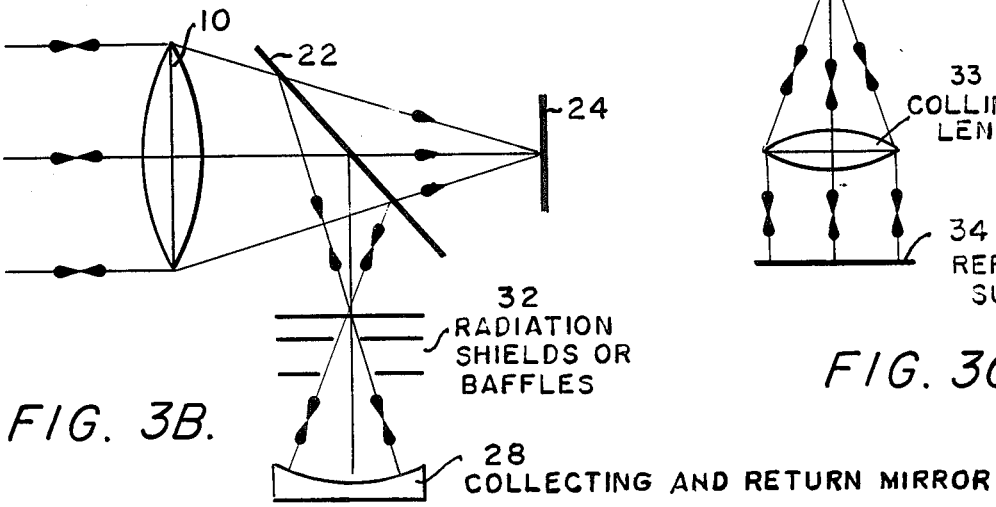

FIG. 3C depicts a further modification of the second embodiment of the invention which allows power handling capabilities greater than the device shown in FIG. 3A. In operation, collimating lens 33 focuses the light reflected by the beam splitter on a large reflecting surface 34 similar to reflecting surface 26 in FIG. 3A. The collimated radiation from collimating lens 33 is reflected back from reflecting surface 34 whereupon the radiation continues to reverse its path until it exits the optical system. In effect a magnified image is formed on reflecting surface 34 of the image that would normally appear on reflecting surface 26 of FIG. 3A. Since the image is expanded on reflecting surface 34 it can handle incoming radiation which under other circumstances could not be handled by the reflective surface 26 in FIG. 3A.

Thus the invention will not allow the exact operating frequency or band of operation of the true sensor to be determined, but instead will only allow the reduction of possibilities to a few selected bands or frequencies. In addition, the beam splitter 22 of the second embodiment is flat and has a relatively small surface, and is thereby easily coated with an interference filter at a reasonable cost while accurately maintaining the frequency of its bandpass. Also, the present invention is compatible with presently existing systems and could be installed in them with out considerable modification.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United State is:

1. in a remote sensing device comprising an optical element which focuses incoming radiation on a detector, a device for protecting said detector from interrogating radiation comprising:

an optical filter placed over said detecting having a reflective surface;

elemental semi-opaque areas placed on said optical filter which absorb light of specific frequencies.

2. In a remote sensing device comprising an optical element which focuses incoming radiation on a detector, a device for protecting said detector from damaging and interrogating radiation comprising:

a beam splitter placed between said optical element and said detector;

a reflective surface placed so that light reflected from said beam splitter is reflected back to said beam splitter and back through said optical element, said reflecting surface having elemental semi-opaque areas which absorb light of specific frequencies.

3. The device of claim 2 wherein a collimating lens is placed between said reflecting surface and said beam splitter so that light from said beam splitter is focused on said reflecting surface.

* * * * *